United States Patent [19]

Freitag

[11] Patent Number: 4,795,370

[45] Date of Patent: Jan. 3, 1989

[54] ELECTRICAL PLUG CONNECTOR FOR CO-AXIAL LEADS

[76] Inventor: Wolfgang Freitag, Arndtstrasse 9-11, 2351 Trappenkamp, Fed. Rep. of Germany

[21] Appl. No.: 6,996

[22] Filed: Jan. 27, 1987

[30] Foreign Application Priority Data

Feb. 8, 1986 [DE] Fed. Rep. of Germany ..... 3604093

[51] Int. Cl.[4] ..... H01R 17/18

[52] U.S. Cl. ..... 439/584

[58] Field of Search ..... 339/89 C, 90 C, 177, 339/182, 183, 14 R, 14 P, 196, 206, 143; 174/75 C, 88 C

[56] References Cited

U.S. PATENT DOCUMENTS

| | | | |
|---|---|---|---|
| 3,686,623 | 8/1972 | Nijman | 439/584 |
| 3,854,789 | 12/1974 | Kaplan | 339/177 R |
| 3,977,752 | 8/1976 | Freitag | 339/177 E |
| 4,346,958 | 8/1982 | Blanchard | 339/177 R |
| 4,447,107 | 5/1984 | Major et al. | 339/177 E |

*Primary Examiner*—David Pirlot

*Attorney, Agent, or Firm*—Balogh, Osann, Kramer, Dvorak, Genova & Traub

[57] ABSTRACT

An electrical plug connector for co-axial leads is disclosed comprising an inner contact with spring tongues to retain a core wire therebetween and an outer contact for connection to the sheath conductor. The latter may be brought into contact with claws situated at end of the outer contact from which the lead extends, by bending the claws radially inwards, this being accomplished by tightening a screw element situated on an outer sleeve of insulating material, while two coaxial insulating members within the outer contact are displaced axially with respect to each other so that thrust arms situated on one insulating member and co-operating with an inwardly tapering cam surface may be thrust against the spring tongues to allow these to grip fast the inner lead wire. A plug connector of particularly uncomplicated structure can be produced substantially automatically because the two insulating members are joined together interengagingly and because the one-piece outer contact consists of two cohesive shells surrounding the insulating members.

4 Claims, 1 Drawing Sheet

ELECTRICAL PLUG CONNECTOR FOR CO-AXIAL LEADS

BACKGROUND OF THE INVENTION

1. Field of the Invention

The invention relates to an electrical plug connector for co-axial leads. More particularly the invention relates to plug connectors of the type comprising an inner contact for connection to a core wire which may be plugged axially into an aperture of the inner contact which is delimited by spring tongues, and an outer contact for connection to a sheath conductor which may be coupled with claws situated at one end of the outer contact. The sheath is generally attached by a bending action performed substantially radially in the inward direction by turning in one direction a screw element, mounted on a sleeve of insulating material, then bending the claws inwardly. Two insulating members situated on the same axis are simultaneously displaced axially with respect to each other so that thrust arms situated on one said insulating member may thereby be pressed by a tapered cam surface situated on the other said insulating member and co-operating with the thrust arms against the spring arms to allow these to grip the core wire firmly. The invention furthermore relates to a method for the production of a plug connector of this nature.

2. Description of the Prior Art

Plug connectors of this kind were disclosed for example in the German Patent specification No. 24 25 070 and may be produced and utilised for example as a plug or junction, depending on the nature of their contacts and shape. Although they are normally quite satisfactory in their operation and application, some disadvantage may however be discerned in their still rather complex structure and the commensurately costly assembly of the components, whereby automation of the production, which is desirable on the grounds of cost, has not been possible without difficulty until now.

SUMMARY OF THE INVENTION

It is accordingly an object of the invention to devise a plug connector of comparatively uncomplicated structure, which also offers the possibility of a largely automated and thus economic production and assembling method. Furthermore, an advantageous method for the production of a plug connector of this nature is proposed.

To this end, a plug connector of the type referred to in the foregoing is so constructed according to the invention that the two insulating members are joined together interengagingly and that the one-piece outer contact comprises two sheets which are joined together and surround the insulating members.

In view of the interengaging connection of the insulating members, these may be prefabricated for installation inclusive of the inner contact inserted into one of the insulating members and introduced into the assembling operation at a particular process stage, without incurring the otherwise prevailing risk of the insulating members being separated during handling. A precise and constant axial alignment of the insulating members is also assured, especially if the connection between these insulating members is so devised that the thrust arms bear on the tapered surface continuously and centre the insulating members with respect to their common axis.

Furthermore, the insulating members may be held together by a detent joint which allows an axial relative displacement and which by means of a stop delimits the maximum displacement path of the one insulating member with respect to the other in one direction. The stop may be formed as an enlargement extending circumferentially around one of the insulating members, behind which engage the detent projections of resiliently deflectible tongue situated on the other insulating member.

The whole outer contact preferably comprises one element, so that the previously customary multisectional structure of this contact is eliminated thereby simplifying the assembly of the plug connector on the one hand and saving expense on the other hand, particularly since the whole outer contact may now be produced by an inexpensive stamping, in which connection the stamping may enflank the insulating members after appropriate shaping, substantially in the manner of two cohesive shells forming a sleeve.

Furthermore, the method for the production and assembly, respectively, of the plug connector may appropriately be performed in the following process stages:

a. for production of the outer contact, a blank is stamped out of a flat strip of conductive material, said blank including portions which are subsequently to be deformed to produce the claws and the sleeve-shaped contact element, b. two substantially cohesive adjacent shells are formed from this stamping, c. the insulating members previously joined interengagingly are placed in one of the shells, the inner contact being situated in one of the insulating members, d. the other shell is laid over the insulating member to form the sleeve-like outer contact element, e. the claws are formed during one of the aforesaid process stages or during a separate operation following the process stage d, as desired, and f. the outer sleeves and the screw element are assembled subsequently.

Further features and advantages of the invention will become apparent from the following detailed description, taken in conjunction with the accompanying drawings, wherein a preferred embodiment of the invention is illustrated.

DETAILED DESCRIPTION OF THE PREFERRED EMBODIMENT

The fundamental structure, the operation and application of a plug connector of the kind to which the invention relates are largely known (German Pat. No. 24 25 070) so that no more than the only parts which will be described in detail are those essential to an understanding of the invention.

Figure 1:
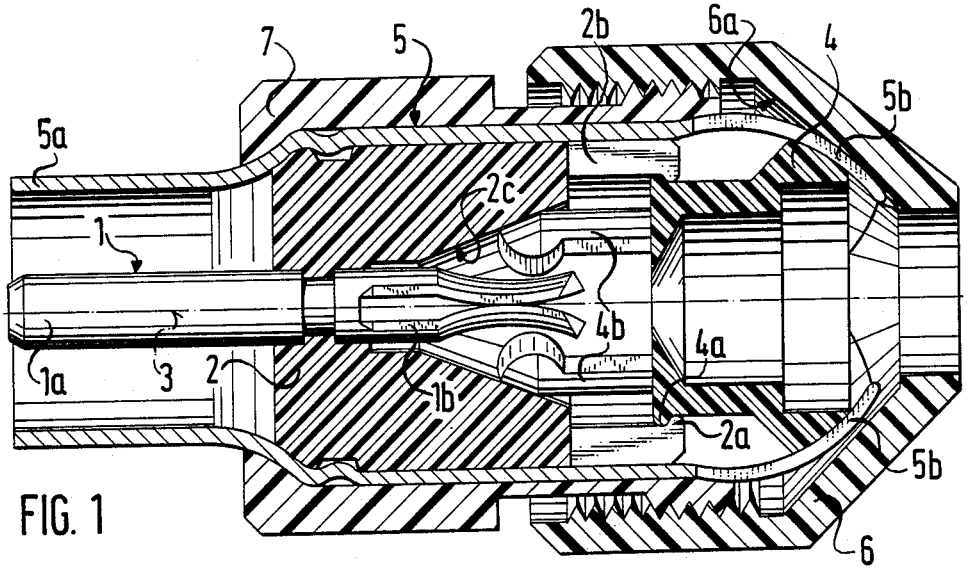
FIG. 1 shows a longitudinal cross-section through a plug connector constructed as a plug.

Referring first to FIG. 1, an inner contact 1 is constructed as a pin 1*a* at the outer extremity and at the other extremity carries spring tongues 1*b* which bear in known manner against the core conductor of the coaxial lead which is not shown but which is intended to be inserted into the plug from the right according to FIG. 1. The inner contact 1 is firmly seated in an insulating member 2 moreover, which interengages with another insulating member 4 situated on the same axis 3.

The interengagement is produced in the manner of a detent connection, in which inwardly directed detent projections 2*a* situated on the free extremities of tongues 2*b* of the insulating member 2 engage behind an outwardly directed rim 4*a* of the other insulating member 4. To join the two insulating members, these are aligned with respect to the longitudinal axis 3 and moved towards each other so that under separation of the tongues 2*b*, the detent projections 2*a* slide over the rim 4*a* and then snap inwards behind the rim. The areas in mutual contact of the detent projections and of the rim are appropriately made to extend plane and radially to form a durable joint which reliably prevents accidental separation of the two insulating members.

The joint thus produced moreover forms a stop which delimits the maximum displacement path in the direction of elongation or separation of the two insulating members, whereas a displacement in the direction of an approach between the insulating members is allowed and this displacment them encounters its limit when the thrust arms 4*b* situated on the insulating member 4 slide so far on the tapered cam surface 2C and are bent so far inwards, that they cause the spring tongues 1*b* to be firmly pressed on to the core conductor of the lead.

Furthermore, the connection between the insulating members 2, 4 is so devised that the thrust arms 4*b* constantly bear on the tapered surface 2*c* and centre the two insulating members with respect to their common axis 3. This has the advantage that the two insulating members may be pre-assembled and may be inserted precisely in a constantly aligned position during a particular process stage in the production of the plug connector.

The outer conductor 5 substantially surround the inner contact element 1 and the insulating member 2 in the form of a closed sleeve, the inner contact element 1 and the front outer contact element 5*a* evidently corresponding in diameter to the standardised dimensions. At the extremity which is the right-hand extremity in the drawing, the outer contact 5 carries four claws 5*b* for example, which bear on the inside on a convex surface of the insulating member 4 and on the outside on the tapered inner surface 6*a* of a cap nut 6 which acts as a screw element and is screwed to an external sleeve 7. The elements 6 and 7 are made of insulating material.

The claws 5*b* are bent inwards by tightening the cap nut, so that they penetrate into the screening of the lead and come into contact with it. At the same time, the insulating member 4 is displaced axially in the direction towards the other insulating member 2, the spring tongues 1*a* thereby being placed in intimate contact with the core wire as already described.

Figure 2:
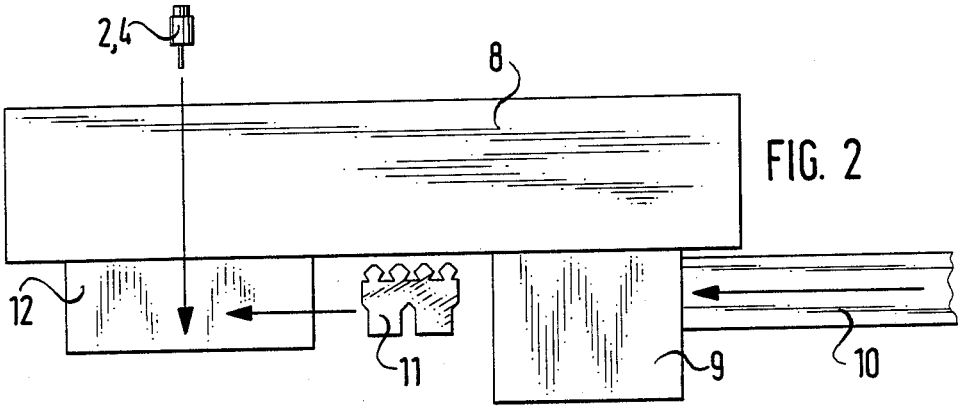
FIG. 2 shows a device for production and assembly of the plug connector in diagrammatical and simplified manner.
Figure 3:
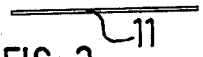
FIGS. 3 to 6 show the results of different process stages during the production of the outer contact in end view.

According to FIG. 2, the device for producing and assembling the plug comprises and automatic stamping and bending machine 8. A flat metal strip 10 is fed to the punch 9 for timed production of stampings 11 (FIG. 3) each stamping acting as a blank for further deformation for the production of an outer contact 5. As shown in FIG. 2, this blank also comprises the portions from which the four claws 5*b* and the sleeve-like part 5*a* of the outer contact are intended to be produced subsequently.

Figure 5:
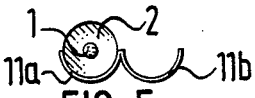
Figure 6:
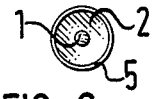

The stamping 11 is then bent or pressed in a bending mechanism 12 provided with several tools, into two cohesive shells 11*a*, 11*b* which are adjacent and open towards the same side (FIG. 4), so that the previously joined insulating members 2, 4 may now be laid into the shell 11*a* for example (FIG. 5), these being fed automatically to the bending mechanism 12 together with the inner contact 1 already present in the insulating member 2, and laid into the shell 11*a* in question, in the same. Finally, the free shell 11*b* is turned by being swaged over and moulded over the insulating members 2, 4 thereby forming the product shown in FIG. 6, having a substantially sleeve-shaped outer contact 5.

Figure 4:
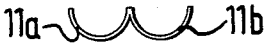

The claws 5*b* may subsequently be formed to the required shape subsequently during a separate operation by being bent or pressed within the machine section 12, although it would be more appropriate to form the claws as well during one of the previously described process stages, that is to say for example whilst bending the stamping 11 to the shape according to FIG. 4.

The subsequent fitting of the outer sleeve 5 and of the cap nut 6 may also be performed automatically by appropriate design of the device, since only comparatively uncomplicated insertion and screwing operations are fundamentally required for this purpose.

In conclusion, it is also pointed out that the thrust arms, the taper for their radial displacement, the tongues comprising the detent projections and the matching rim or enlargement may, contrary to the illustration, also be provided on the other insulating member in each case. Furthermore not only plugs, but also connectors and electrical plug-in connectors of this nature may be produced with the features of the invention.

I claim:

1. An electrical plug connector for coaxial leads comprising:

an inner contact having at one end thereof resilient tongues to receive a core wire of a coaxial lead inserted axially therebetween;

a first insulating member coaxial with said inner contact and having a radially inwardly tapering cam surface located around said tongues of said inner contact;

a second insulating member coaxial with the first insulating method and having thrust arms projecting between said cam surface and said tongues, interengaging means on said first insulating member and said second insulating member for maintaining both of said members in engagement, said first and second insulating members being movable axially towards and away from one another;

an outer contact comprising two connected shells surrounding said inner contact and said insulating members and having radially deformable claws to contact a sheath of said coaxial lead;

an outer sleeve of insulating material surrounding said outer contact;

a screw element threadedly connected to said outer sleeve and arranged, when rotated in one direction relative thereto, to bend said claws inwardly and to push said first and second insulating members axially towards one another whereby said thrust arms are displaced radially inwardly by said cam surface to push said tongues together to grip the core wire;

said interengaging means comprising detents engageable with tongues for holding said first and second insulating members together and allowing a relative axial displacement of the insulating members and including a stop to limit the maximum displacement path of the one insulating member with respect to the other insulating member, in one direction;

said stop being formed as an enlargement extending circumferentially on one of said insulating members behind which engage detent projections of resiliently deflectible tongues situated on the other insulating member.

2. A plug connector as claimed in claim 1, wherein the connection between the first and second insulating members is so arranged that the thrust arms constantly bear on the tapered cam surface and centre the two insulating members with respect to their common axis.

3. A method for the production of an electrical plug connector as claimed in claim 1, comprising the following process stages:

a. punching out a blank out of a flat strip of conductive material to form said outer contact, said blank including elements subsequently to be deformed to produce the claws and a sleeve-like contact element;

b. forming two adjacent and connected half-shells from said blank, which half-shells form a buckling at their connected edges;

c. placing said first and second insulating members, previously joined together by interengagement, in one of said half-shells, the inner contact being situated in one of said insulating members;

d. bending the other half-shell over the insulating members to form the sleeve-like outer contact element;

e. forming said radially deformable claws on said shells which form said outer contact; and f. fitting the outer sleeve and the screw element around said outer contact.

4. An electrical plug connector for coaxial leads comprising:

an inner contact having at one end thereof resilient tongues to receive a core wire of a coaxial lead inserted axially therebetween;

a first insulating member coaxial with said inner contact and having a radially inwardly tapering cam surface located around said tongues of said inner contact;

a second insulating member coaxial with the first insulating member and having thrust arms projecting between said cam surface and said tongue, interengaging means on said first insulating member and said second insulating member for maintaining both of said members in engagement, said first and second insulating members being movable axially towards and away from one another;

an outer contact comprising a stamped and bent shell surrounding said inner contact and said insulating members and having radially inwardly deformable claws to contact a sheath of said coaxial lead;

an outer sleeve of insulating material surrounding said outer contact;

a screw element threadedly connected to said outer sleeve and arranged, when rotated in one direction relative thereto, to bend said claws inwardly and to push said first and second insulating members axially towards one another whereby said thrust arms are displaced radially inwardly by said cam surface to push said tongues together to grip the core wire;

said interengaging means comprising detents engageable with tongues for holding said first and second insulating members together and allowing a relative axial displacement of the insulating members and including a stop to limit the maximum displacement path of the one insulating member with respect to the other insulating member, in one direction;

said shell comprising two half-shells connected together integrally at their one longitudinal edge and being bent around their connection such to form a circular shell;

said stop being formed as an enlargement extending circumferentially on one of said insulating members behind which engage detent projections of resilient deflectable tongues situated on the other insulating member.

* * * * *